United States Patent [19]

Cancian et al.

[11] Patent Number: 4,592,943

[45] Date of Patent: Jun. 3, 1986

[54] OPEN MESH BELT BONDED FABRIC

[75] Inventors: Annamaria C. Cancian, Appleton, Wis.; Charles J. Shimalla, Kendall Park, N.J.

[73] Assignee: Chicopee, New Brunswick, N.J.

[21] Appl. No.: 598,657

[22] Filed: Apr. 10, 1984

Related U.S. Application Data

[63] Continuation-in-part of Ser. No. 430,310, Sep. 30, 1982, abandoned.

[51] Int. Cl.[4] ..... B32B 5/14

[52] U.S. Cl. ..... 428/171; 428/156; 428/255; 428/296; 428/373

[58] Field of Search ..... 28/105; 428/255, 296, 428/373, 156, 171, 172

[56] References Cited

U.S. PATENT DOCUMENTS 4,042,740 8/1977 Krueger ..... 428/296

4,068,036 1/1978 Stanistreet ..... 428/296

*Primary Examiner*—James J. Bell

*Attorney, Agent, or Firm*—Nancy A. Bird

[57] ABSTRACT

An apparatus, method and fabric formed thereby for heat or fusion bonding a web comprising conjugate fibers.

6 Claims, 8 Drawing Figures

OPEN MESH BELT BONDED FABRIC

This application is a continuation-in-part application of copending application Ser. No. 430,310, filed Sept. 30, 1982 now abandoned.

BACKGROUND OF THE INVENTION

Method and apparatus for drying and heat setting fibrous webs are known. One such method and apparatus is set forth in U.S. Pat. No. 3,442,740. The apparatus described comprises the rotating heated roll and flexible endless restraining belt which travels around the roll. A web is inserted between the belt and the roll. In the modification described in this patent, the web travels around the roll under the restraining belt. The web is doffed from the heating roll onto the belt which transports it to a cooling roll. The web travels around the cooling roll while under the restraining belt and is then doffed from the roll and the belt.

In the commercially available Honeycomb Dryer, a fibrous web is passed around a foraminous roll while being subjected to forced air heat directed toward the outside surface of the roll. This apparatus, although originally used for drying fibrous webs, has been suggested for use in fusing fibrous webs comprising thermoplastic materials. One modification of the apparatus and method comprises the use of a restraining belt extending about the roll, which belt is laid down atop the fibrous web to restrain the web against the surface of the roll during the bonding or drying process. The foraminous surface of the roll creates a smooth fabric face. In the method and apparatus of the present invention, an open mesh network is disposed about the surface of the roll or substituted for the surface of the roll. The open mesh network surface molds the fabric creating a puffed surface.

Copending Application Docket No. CHIC-654 discloses the use of an open mesh belt as a restraining belt in the Honeycomb dryer. That application also discloses the use of an open mesh belt adjacent a web and between two carrier belts. The fabrics formed have a patterned surface formed by the tension of the open mesh belt against the web during bonding of the fabric. The fabrics have good strength and high loft.

U.S. Pat. No. 4,103,058 describes a puffed melt blown fabric made by collecting the melt blown fibers on a perforated screen. Compacted, high density regions are formed between the puffs.

SUMMARY OF THE INVENTION

The present invention comprises an apparatus, method and fabric formed thereby for thermal bonding a web comprising at least 10 percent conjugate fibers. In the apparatus of the present invention, an open mesh network comprises or is superimposed on a moving surface such as a rotating drum and a source of forced heated air is directed toward the open mesh network. In the method of the present invention, a fibrous web comprising conjugate fibers comprising a low melting point thermoplastic component is fed to and superimposed over the open mesh network rotating on the rotating drum. Forced heated air impinging on the web molds the web and puffs the fibers out of the plane of the fabric into the open areas of the open mesh network and fuses the low melting point component of the conjugate fibers in the web. The fabric formed thereby is a very high loft fabric having patterned puffed regions on one surface thereof. The method of the present invention may also be practiced using a restraining belt causing regions of densification between the puffed regions. The use of a conventional smooth surfaced restraining belt compresses the web against the open mesh structure creating regions of densification between the puffed regions of the fabric and a smooth surface on the opposite side of the fabric. If the restraining belt is formed of another open mesh network, it will create densified regions as above, and will create a pattern of embossed type densified regions on the surface of the fabric opposite the puffed surface.

DETAILED DESCRIPTION OF THE DRAWINGS

Figure 1:
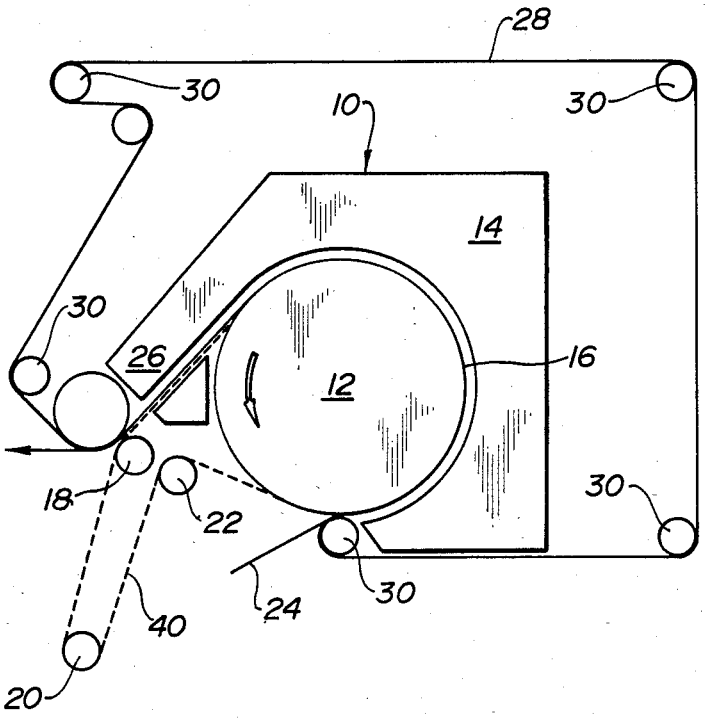
FIG. 1 is a schematic side view of an apparatus according to the present invention.

FIG. 1 illustrates schematically and in cross-section an apparatus according to the present invention. In the preferred embodiment shown, the apparatus comprises a framework shown generally at 10 with a movable surface comprising in this embodiment a rotatable drum 12. The apparatus has heating means (not shown) within the frame at 14. The heating means directs forced heated air onto the outside of the movable surface. Though it is not necessary that the path of the movable surface comprise a curve when as in this embodiment, when it does, it is preferred to exhaust the confluence of forced air by drawing a vacuum from a point within the curve. Most preferably the force of the impinging air and the vacuum are balanced, which balance is dependent on the web being processed.

In the improved apparatus of the present invention, an open mesh network 16 is superimposed on the movable surface. The open mesh network may comprise an endless belt as shown, which extends away from the roll 12 and is transported back to the roll by means 18, 20, and 22 for moving an endless belt open mesh structure to and from the movable surface. In an alternate embodiment, the open mesh network may be wound tightly about just the drum. In still another alternative, the open mesh network may be used to form the surface of the drum or movable surface. In the preferred embodiment shown, the endless belt open mesh network has two advantages. The endless belt open mesh network may be used to transport the web to a cooling station as will be described later; and may be easily replaced by another open mesh network of different configuration.

Figure 2:
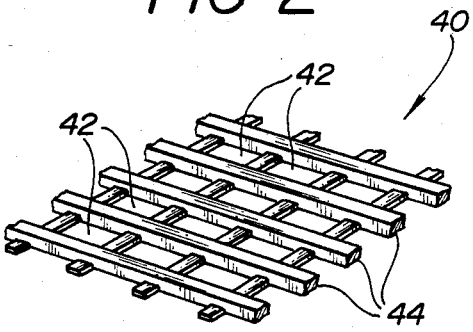
FIG. 2 is a perspective view of a portion of an open mesh network for use in the apparatus and method according to the present invention.

A portion of an open mesh structure for use in the apparatus and method according to the present invention is shown at 40 in FIG. 2. The open mesh structure has open areas 42 and also has a depth 44. In the method according to the present invention, a web 24 comprising at least 10 percent conjugate fibers is disposed across a moving open mesh structure surface and the exposed side of the fabric is then subjected to forced heated air. The fibers disposed across the open areas 42 are bent out of the plane of the web and into the open regions by the forced heated air thereby creating a fabric having a pattern of puffed regions of lesser density than the overall fabric created by the fibers bent out of the plane of the fabric. The forced heated air also heats and fuses the low melting point component of the conjugate fibers of the web to fibers in the web. The apparatus of the present invention may also comprise a cooling station (not shown) at 26 which in its preferred embodiment comprises forced cooled air. In a still preferred embodiment, the means for carrying the endless belt open mesh away from the drum may comprise means for carrying the open mesh network into the cooling station.

Figure 3:
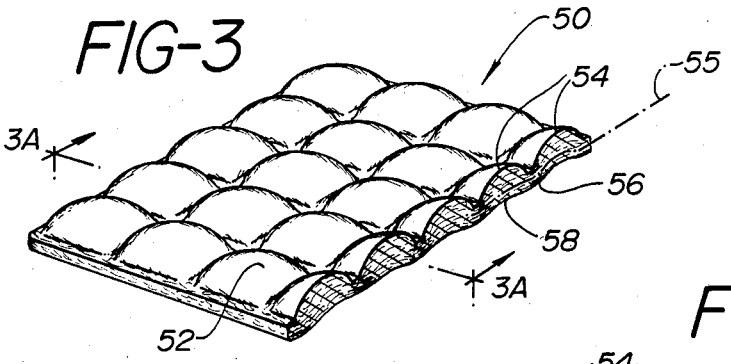
FIG. 3 is a perspective view of one embodiment of a fabric formed according to the method of the present invention.
Figure 3A:
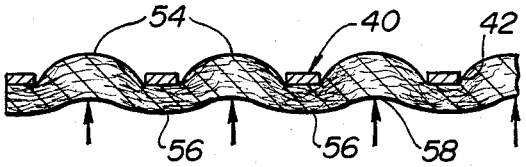
FIG. 3A is a fragmentary section of the fabric of FIG. 3 illustrating schematically how the fabric is formed.

FIG. 3 depicts a fabric formed according to the present invention. The fabric shown generally at 50 has a very high loft and low density. One face 52 of the fabric comprises a pattern of puffed regions 54 wherein the fibers are bent out of the plane 55 of the fabric. As shown in FIG. 3A, these puffs are formed in the open areas 42 of the open mesh structure by the forced heated air. These puffed regions have lower density than the overall fabric. The other surface 56 of the fabric may have a pattern of recesses 58 corresponding to the puffed regions 54. At lower air velocities, the fabric formed has a substantially uniform density throughout, with puffed regions and recesses being matched to give a molded fabric wherein the entire fabric is moved into the open areas, 42, of the open mesh structure.

In a preferred construction, the nonwoven fabrics of the present invention are made from polyester/-polyethylene conjugate fibers wherein at least about 50 percent of the surface of the individual fibers is polyethylene. It is preferred to employ sheath/core fibers with the polyethylene as the sheath and the polyester as the core. Either eccentric or concentric sheath/core fibers can be employed. The fibers will usually have a denier within the range of from about 1 to about 6, and are in excess of about ½-inch in length, up to about 3 or 4 inches long.

Preferably, the conjugate fibers employ high density polyethylene, that is, linear polyethylene that has a density of at least about 0.94, and a Melt Index ("M.I.") by ASTM D-1238(E) (190° C., 2160 gms.) of greater than 1, preferably greater than about 10, and more preferably from about 20 to about 50. Usually the fibers will be composed of about 40 to 60 weight percent, and preferably 45 to 55 weight percent, polyester, the remainder being polyethylene.

In the fabrics of the present invention other fibers, preferably nonabsorbent staple fibers such as polyester fibers, can be used along with the polyester/polyethylene conjugate fibers.

The fabrics of the invention are produced by first forming a fibrous web comprising a loose array of the conjugate fibers, as by carding, air laying, or the like. The exact weight of the fibrous web has not been found to be narrowly critical, although useful weights have been found within the range from about 0.2 to about 4.2 ounces per square yard.

The web comprising a loose array of polyester/-polyethylene conjugate fibers is laid on an open mesh network surface and passed under forced air heating means. The forced heated air pushes the fibers in open areas of the mesh out of the plane of the fabric and fuses the polyethylene component of the conjugate fibers and form bonds at points of fiber-to-fiber contact. Forced heated air at a face velocity of at least 100 ft./min. is applied to a circular drum with a vacuum drawn at three-tenths inches of water within the drum. The exact temperatures employed will vary, depending upon the weight and bulk density of the web, and upon the dwell time employed in the heated zone. For instance, bonding temperatures within the range from about 130° to about 180° C., have been found satisfactory. Dwell times in the heated zone will usually vary from about 2 seconds to about 1 minute, and more normally will be from about 3 to about 10 seconds.

Figure 4:
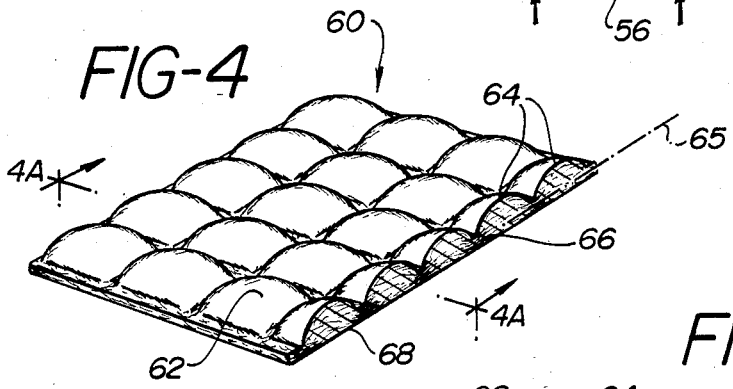
FIG. 4 is a perspective view of another embodiment of a fabric formed according to the present invention.
Figure 4A:
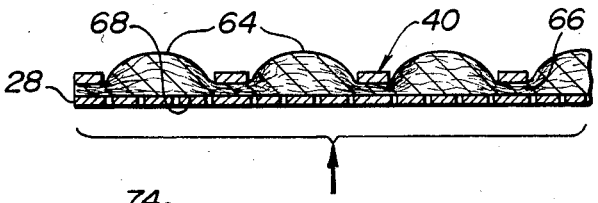
FIG. 4A is a fragmentary section of the fabric of FIG. 4 illustrating schematically how the fabric is formed.

In an alternative embodiment of a method and apparatus of the present invention, an air permeable restraining belt 28 may be provided and carried along means 30 for causing said restraining belt to travel along with the open mesh network surface. The restraining belt compresses the web against the open mesh network creating a fabric as shown at 60 in FIG. 4. The fabric has one surface 62 comprising puffed regions 64 wherein the fibers are bent out of the plane 65 of the fabric. The puffed regions have very low density. As shown especially in FIG. 4A, the fabric also comprises densified regions 66 which extend between and around the puffed regions. The densification is caused by the compression of the web against the open mesh structure by the belt 28. The other surface of the fabric 68 formed next to the belt 28 is smooth.

Figure 5:
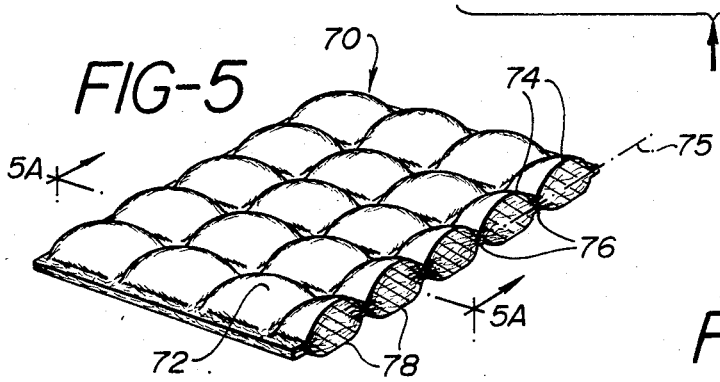
FIG. 5 is a perspective view of another embodiment of the fabric formed according to the method of the present invention.
Figure 5A:
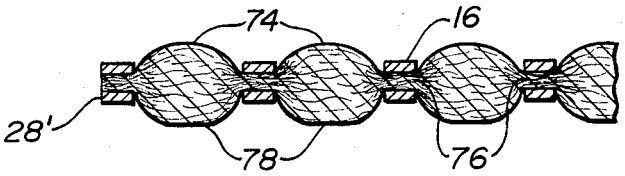
FIG. 5A is a fragmentary section of the fabric of FIG. 5 illustrating schematically how the fabric is formed.

In yet another alternative of the method and apparatus according to the present invention, the restraining belt may comprise an endless belt open mesh network. A fabric formed thereby is shown in FIG. 5. The fabric shown generally at 70 comprises one face 72 which comprises puffed regions 74 wherein the fibers are puffed out of the plane 75 of the fabric, and densified regions 76 therebetween formed by the compression of the web against the open mesh network restraining belt. The fabric also comprises embossed type densification at least at surface 78 introduced by the open mesh network restraining belt. The emboss-type densification gives an embossed type pattern to the other surface 78. As shown in FIG. 5A, the open mesh networks 16 and 28' had the same configuration and were in registry; however, the present invention contemplates different open mesh networks used as the moving surface and as the restraining belt and also contemplates the belts being used when they are not in registry creating a fabric wherein the other surface 78 has embossed type densified regions which do not coincide with the densified regions created by compressing the web against the open web structure moving surface.

The foregoing description and drawings are illustrative but are not to be taken as limiting. Other variations and modifications are possible without departing from the spirit and scope of the present invention.

We claim:

1. A high loft, low density thermal bonded nonwoven fabric comprising at least 10 percent conjugate fibers, said fabric having a patterned surface comprising a pattern of puffed regions wherein the fibers are bent out of the plane of the fabric.

2. A nonwoven fabric as in claim 1 wherein the conjugate fibers are polyester/polyethylene fibers.

3. A nonwoven fabric as in claim 2 wherein the conjugate fibers are sheath/core fibers with the polyethylene as the sheath and the polyester as the core.

4. A nonwoven fabric as in claim 1 wherein said puffed regions have a lower density than the overall fabric.

5. A nonwoven fabric as in claim 4 further comprising densified regions between the puffed regions.

6. A nonwoven fabric as in claim 5 further comprising an emboss type patterned other surface formed by emboss type densified regions formed in at least the other surface of the fabric.

* * * * *